US009549238B2

(12) United States Patent
Lott

(10) Patent No.: US 9,549,238 B2
(45) Date of Patent: Jan. 17, 2017

(54) EAR HEADPHONE WITH TRAGUS FITMENT FEATURE

(71) Applicant: Aurisonics, Inc., Nashville, TN (US)

(72) Inventor: Phillip Dale Lott, Nashville, TN (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 0 days.

(21) Appl. No.: 14/681,338

(22) Filed: Apr. 8, 2015

(65) Prior Publication Data

US 2016/0301999 A1 Oct. 13, 2016

(51) Int. Cl.
*H04R 25/00* (2006.01)
*H04R 1/10* (2006.01)

(52) U.S. Cl.
CPC ..... *H04R 1/1016* (2013.01); *H04R 1/1058* (2013.01); *H04R 1/1066* (2013.01); *H04R 25/65* (2013.01); *H04R 2201/109* (2013.01); *H04R 2225/025* (2013.01)

(58) Field of Classification Search
CPC ... H04R 1/1008; H04R 1/1016; H04R 1/1058; H04R 1/1066; H04R 5/0335; H04R 25/65; H04R 25/652; H04R 2201/107; H04R 2201/109; H04R 2225/023; H04R 2225/025; H04M 1/05
USPC ..... 381/309, 322, 324, 328, 330, 370, 374, 381/376, 380, 381; 181/129, 130, 135; 379/430, 431
See application file for complete search history.

(56) References Cited

U.S. PATENT DOCUMENTS

| | | | | |
|---|---|---|---|---|
| 6,035,961 | A | 3/2000 | Sun | |
| 6,449,374 | B1 | 9/2002 | Skulley et al. | |
| 7,372,974 | B2 | 5/2008 | Yanagishita et al. | |
| 7,986,803 | B1 * | 7/2011 | DeKalb | H04R 1/1066 381/328 |
| 8,194,910 | B2 | 6/2012 | Uchida et al. | |
| 8,526,600 | B2 | 9/2013 | Howes et al. | |
| 8,625,834 | B2 | 1/2014 | Smith et al. | |
| 8,913,773 | B2 | 12/2014 | Matsuo et al. | |
| 2002/0131585 | A1 * | 9/2002 | Jones | H04M 1/05 379/431 |
| 2011/0075871 | A1 | 3/2011 | Fretz et al. | |
| 2013/0251184 | A1 | 9/2013 | Matsuo et al. | |
| 2016/0073192 | A1 * | 3/2016 | Briggs | H04R 1/1058 381/380 |

OTHER PUBLICATIONS

US 8,712,088, 04/2014, Silvestri et al. (withdrawn)

* cited by examiner

*Primary Examiner* — Huyen D Le
(74) *Attorney, Agent, or Firm* — Hall Estill Attorneys at Law; Tyler J. Mantooth

(57) ABSTRACT

An in-ear headphone may be constructed and operated with at least a housing sized to fit in an external auditory meatus of a user and have at least one audio driver. A fitment feature may extend from the housing and incorporate a plurality of flexible flanges cantilevered from a unitary base. The fitment feature may be configured to engage a tragus of the user to secure the housing within the external auditory meatus.

20 Claims, 3 Drawing Sheets

EAR HEADPHONE WITH TRAGUS FITMENT FEATURE

RELATED APPLICATION

The present application makes a claim of domestic priority to U.S. Provisional Patent Application No. 61/976,707 filed Apr. 8, 2014, the contents of which are hereby incorporated by reference.

SUMMARY

An in-ear headphone, in accordance with various embodiments, has at least one housing with one or more audio drivers. The housing is sized to fit in an external auditory meatus of a user with a fitment feature extending from the housing. The fitment feature is configured to engage a tragus of the user with a plurality of flexible flanges cantilevered from a unitary base to secure the housing within the external auditory meatus.

DETAILED DESCRIPTION

The proliferation of mobile electronic devices capable of storing, processing, and amplifying sound, such as laptop computers, smartphones, and digital music players, have allowed music, audio books, and sounds to be a part of everyday life. The reproduction of sound by headphones has similarly experienced increasing presence in professional and social environments, but the reproduction of sound can be highly personal and further complicated by a wide variety of headphone shapes, sizes, and configurations that surround, sit on, and fit within a user's ear. It is contemplated that fitting a headphone inside a user's ear can provide comfort and efficient reproduction of sound. However, fitment of a headphone within a user's ear is difficult due at least to variances in ear size, ear shape, and comfort preferences of a user.

It is understood that ear molds can be procured by a user and equipped into a headphone to position an audio driver proximal an ear canal. Yet, an outer ear, external auditory meatus, and ear canal can change shape during different activities of the user, such as chewing, exercising, and talking. Such a change in ear shape cannot be accommodated by rigid headphone ear molds shaped for a single ear position and shape. Thus, there is a continued consumer interest in an in-ear headphone that can be secured within an ear of a user and maintain a comfortable fit during a variety of different user activities.

Accordingly, a headphone can be constructed and operated with a housing incorporating at least one audio driver and sized to fit in an external auditory meatus of a user. A fitment feature can extend from the housing and have a plurality of flexible flanges cantilevered from a unitary base to engage a tragus of the user and secure the housing within the external auditory meatus. The use of a flexible fitment feature that can move in relation to the housing can allow the audio driver and housing to be positioned within the external auditory meatus for a wide variety of ear shapes and sizes. The tuned configuration of the plurality of fitment feature flanges to contact at least the tragus and antitragus of the user's ear allows the housing to maintain position within the ear despite sudden, intense, and random ear shape changes encountered during user activity.

Figure 1:
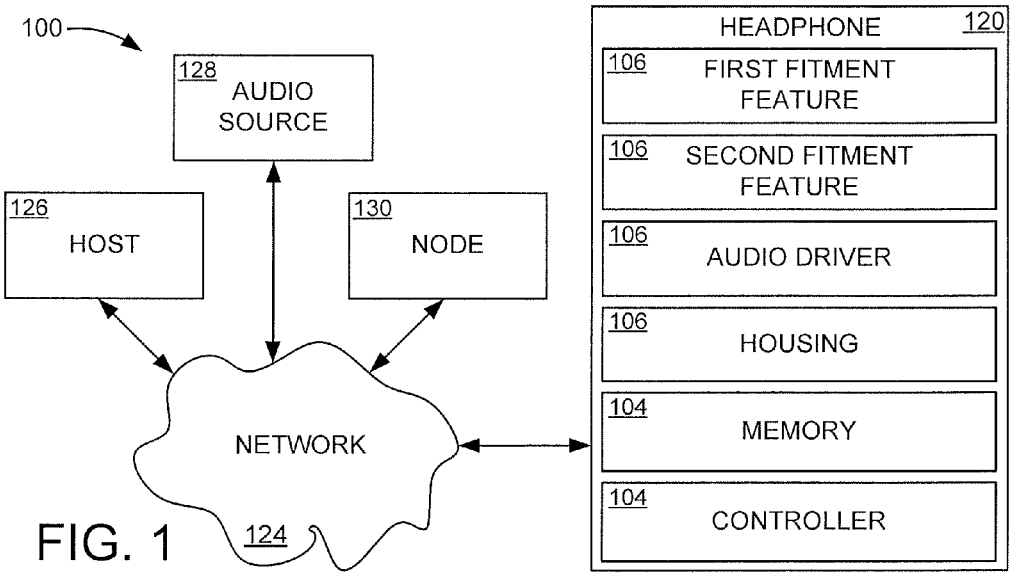
FIG. 1 is a block representation of an example portion of a headphone system configured and operated in accordance with various embodiments.

While an in-ear headphone can be employed in an unlimited variety of systems, the example headphone system 100 of FIG. 1 illustrates a non-limiting environment in which an in-ear headphone 102 can be employed in accordance with various embodiments. The in-ear headphone 102 can be constructed at least a controller 104, such as a microprocessor or application specific integrated circuit (ASIC), that communicates with and directs activity of a memory 106 and audio driver 108. It is contemplated that the memory comprises multiple different types, sizes, and arrays of data storage. For example, the memory 106 may have a volatile cache memory, such as dynamic random access memory (DRAM), and a larger non-volatile main memory, such as flash or other solid-state memory array.

The audio driver 108 may be configured to be one or more sound reproducing means, such as a micro-dynamic speaker, that produce audible and inaudible sound waves that may or may not be amplified from within the headphone 102. The controller 104 may direct reproduction of audio signals by the audio driver 108 to involve alteration of the audio signals by one or more audio processors, such as a digital-to-analog (D/A) converter and filters. The use of one or more audio processors can artificially change sound signals received from a sound source, such as a music recording or live human voice, to provide varying detail, bass, loudness, presence, and clarity in sounds produced by the audio driver 108.

The headphone 102 may have one or more housings 110 that can anchor and protect the controller 104, memory 106, and audio driver 108. In some embodiments, the housing 110 is configured to provide first 112 and second 114 fitment features that can selectively be manipulated and changed to comfortably fit the headphone 102 within an ear of the user and maintain comfort regardless of user activity. The first fitment feature 112 may be a rigid or flexible tip that engages the periphery of an ear canal and an external auditory meatus of the user while the second fitment feature 114 may be tragus engaging structure extending from the housing 110.

It is noted that the capability of the controller 104 to collect, process, and reproduce data and sound signals can be directed by one or more software programs, applications, and routines. Such software may be resident in the memory 106 and streamed from a remote third-party, without limitation, via a wired and wireless network 116. That is, the in-ear headphone 102 may utilize a network 116 with appropriate protocol and to establish and maintain a connection with various remote third-parties, such as a host 118, node 120, and audio source 122, to receive software and data enabling the headphone 102 to function and reproduce sound.

The ability to remotely connect with one or more sources can allow the various aspects of the headphone 102 to be utilized individually and concurrently to optimize the capabilities of the headphone 102. As a non-limiting example, the remote host 118 may receive requested data from the headphone 102 while the audio source 122 is sending sound signals to the headphone 102 that are processed by the controller 104 and subsequently delivered to the user by the audio driver 108.

The ability of the headphone 102 to remotely connect to various external sources can complement the computing means contained in the housing 110, such as the controller 104 and memory 106, and allow the computing power and physical size of the computing means to be smaller. In other words, the ability to utilize the computing power and capabilities of remote third-parties can allow the computing components of the headphone 102 to be smaller and less powerful, which can reduce headphone 102 weight, complexity, and in-ear comfort. It is contemplated that the headphone 102 are a pair of matching in-ear assemblies that are each constructed with a controller 104, memory 106, audio driver 108, housing 110, first fitment feature 112, and second fitment feature 114.

Figure 2A:
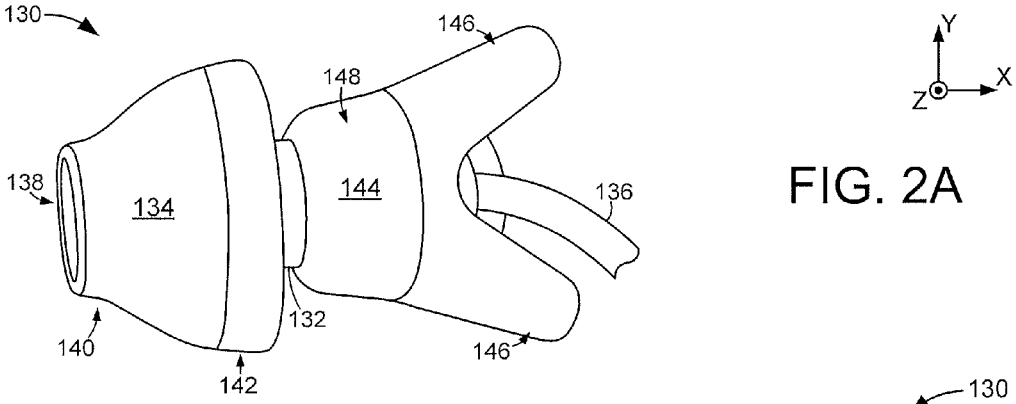
FIGS. 2A and 2B respectively show perspective views of an example in-ear headphone arranged in accordance with some embodiments.
Figure 2B:
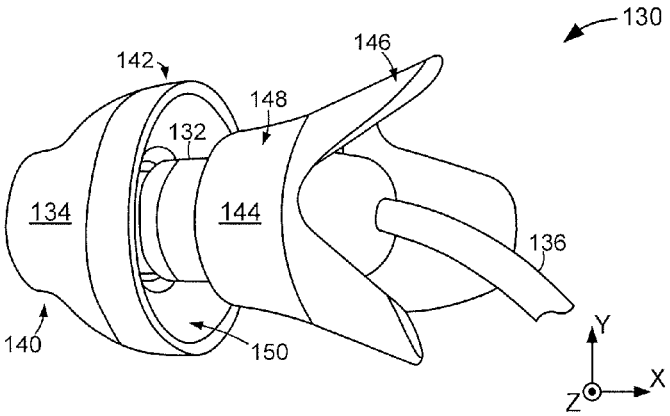

Although not limiting or required, assorted embodiments arrange an in-ear headphone 130 in accordance with the perspective view shown in FIGS. 2A and 2B. The orientation of FIG. 2A illustrates how a housing 132 can secure and position a soft tip 134 first fitment feature at an end opposite a wire 136. The wire 136 may be detachable or permanently affixed within the housing 132 to supply power, data, and sound to at least one audio positioned proximal a sound tunnel 138 aperture of the soft tip 134 and housing 132. The sound tunnel 138 may be open, partially closed, and completely closed either at the housing 132 and soft tip 134 to ensure debris does not clog the sound tunnel 138 and inhibit sound reproduction.

The soft tip 134 has a tuned shape, size, and material that provide a reduced diameter region 140 to contact the periphery of an ear canal of a user in the external auditory meatus of the user's ear. To clarify, the soft tip 134 can have an enlarged region 142 with a larger diameter than the reduced diameter region 140 to increase the depth of insertion of the soft tip 134 into the external auditory meatus of the user. It is contemplated that the soft tip 134 can be removed and replaced with tips configured with different sizes, shapes, and materials. It is further contemplated that the soft tip 134 may be configured to swivel with respect to the housing 132 to allow a diverse variety of headphone 130 orientations within the user's ear to contact and seal onto the periphery of the ear canal.

It is acknowledged that the soft tip 134 may be insufficient by itself to secure the headphone 130 within the ear of a user during activities like talking and chewing. Hence, the housing 132 can be shaped to allow a tri-tab 144 second fitment feature to extend from a portion of the housing distal the soft tip 134. The tri-tab 144 can be partially or completely flexible and be shaped to provide at least two cantilevered tabs 146. Although not required or limiting, one or more cantilevered tabs 146 can be shaped to engage specific portions of a user's ear, such as the tragus and antitragus. In some embodiments, the cantilevered tabs 146 are separated, but continuous extensions from a unitary base 148, which allows the tabs to be manipulated while maintaining enough rigidity to secure the headphone in the user's ear.

The headphone 130 orientation displayed in FIG. 2B shows how the soft tip 134 can have a hollow portion 150 that partially extends towards the sound tunnel 138 and allows the soft tip 134 to flex and conform to the size and shape of a user's external auditory meatus. It can be appreciated that the headphone 130 can be tuned for size, shape, and material to accommodate a wide range of ear configurations. The ability to tune the soft tip 134 and tri-tab 144 components independently can enable the headphone 130 to be customized for the fit, feel, and sound a user desires. For instance, the user may change the soft tip 134 to provide more, or less, of a seal about the ear canal of the user so that an adjusted amount of ambient noise is recognizable.

Figure 3A:
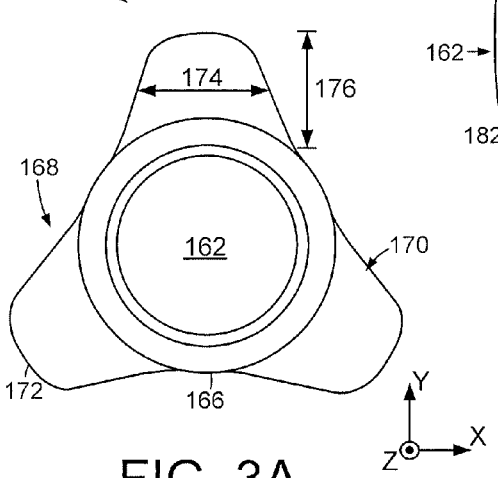
FIGS. 3A-3D respectively depict various views of assorted portions of an example in-ear headphone configured in accordance with various embodiments.

FIGS. 3A, 3B, 3C, and 3D respectively display assorted views and portions of an example in-ear headphone 160 configured in accordance with various embodiments. FIG. 3A is a front view of an assembled headphone 160 that shows how the sound tunnel 162 provides access to at least one audio driver contained in a housing 164. The sound tunnel 162 is defined by the soft tip 166 fitment feature that surrounds the sound tunnel 162, but can be manipulated to different shapes due to its flexible material configuration. The front view of FIG. 3A further shows how a tri-tab 168 fitment feature positions cantilevered tabs 170 equidistant about the housing 164 and sound tunnel 162.

While the respective cantilevered tabs 170 are shown having similar shapes and sizes, as defined by an external boundary 172, width 174, and length 176 from the housing 164, various embodiments may construct the cantilevered tabs 170 with different shapes and sizes to more efficiently engage the tragus and antitragus of a user's ear. For example, a first cantilevered tab 170 may have a rectangular shaped boundary 172 and enlarged width 174 while a second cantilevered tab 170 has a continuously curvilinear boundary 172, smaller width 174, and greater length 176 to ensure engagement with a tragus or antitragus of a user.

Figure 3B:
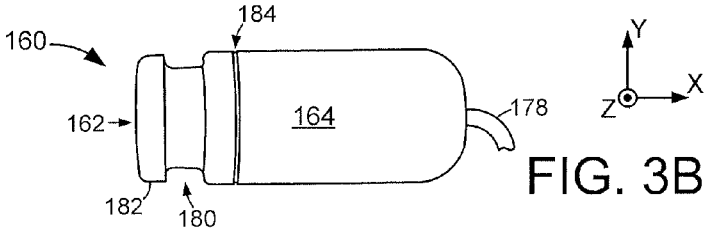

FIG. 3B displays a side view of the housing 164 on which the soft tip 166 and tri-tab 168 fitment features can contact. The housing 164 may be unitary, such as a single hollow shell, or an assembly of multiple components connected via one or more fastening means, such as threads, snaps, and soldered seams. The housing 164 may receive one or more electrical wires 178 that can provide an electrical connection as well as a means for positioning the housing 164 and headphone 160 inside a user's ear. It is contemplated that the wire 178 and connection to the housing 164 are delicate. As such, various embodiments configures the wire 178 as a lamination of an electrical conductor, such as copper, silver, or gold, and strengthening layers, such as Kevlar or carbon-fiber.

The shape and size of the housing 164 is not limited to a particular configuration, but some embodiments tune the audio driver portion 180 of the housing 164 to accommodate a 5.1 mm micro-dynamic audio driver. The audio driver portion 180 may further be configured with a partial or continuous reduction in thickness that defies a bulbous end 182 to which the soft tip 166 can engage and be secured. The housing 164 may be constructed with a predetermined exterior finish to provide a reduced friction factor that allows the tri-tab 168 to be secured, but selectively manipulated upon application of sufficient force. For example, the housing 164 can have a polished TiN finish that can hold the tri-tab feature 168 in place when positioned inside a user's ear, but can be overcome by user manipulation to translate the tri-tab feature 168 to different locations on the housing 164 between the wire 178 and a stop notch 184.

Figure 3C:
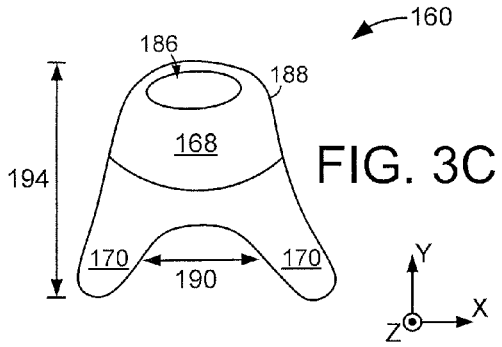

The shape and size of the tri-tab feature 168 can be instrumental in tuning how the housing 164 can be comfortably oriented within a user's ear. FIG. 3C displays an example tri-tab portion of the headphone 160 disassembled from the housing 164. The tri-tab has a housing aperture 186 that can partially and completely surround the housing 164. The housing aperture 186 can be sized to provide a predetermined amount of friction with the housing 164 that allows the tri-tab feature 168 to be selectively positioned relative the housing 164.

The perspective of FIG. 3C illustrates how the cantilevered tabs 170 can be tuned to be biased outward from the unitary body 188, which allows for efficient and comfortable engagement with the tragus and antitragus of the user's ear. The separation distance 190 and feature length 192, including the unitary body 188 and tab 170 lengths, can also be tuned to accommodate differently configured ears. For instance, the in-ear headphone 160 may be packaged with several tri-tab features 168 that are differently configured, such as with different separation distances 190, lengths 192, and numbers of cantilevered tabs 170, and interchangeable on the housing 164 to allow the user to customize the fitment of the headphone 160.

Figure 3D:
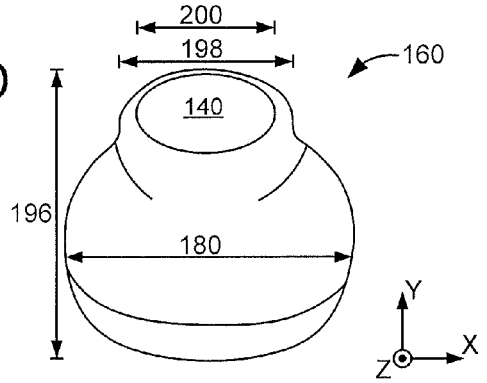

The soft tip feature 166 shown in FIG. 3D can also be structurally tuned to provide optimized customizable fitment for the in-ear headphone 160. That is, the enlarged diameter 194, length 196, reduced diameter 198, and sound tunnel aperture diameter 200 of the soft tip 166 can respectively be tuned to provide different configurations that can be selected by the user. As a non-limiting example, the in-ear headphone 160 can be configured to securely engage a variety of different soft tips 166 having varying shapes and sizes, which can be interchanged and selected to accommodate diverse listening conditions, such as a first soft tip for exercising, a second soft tip for stable working, and a third soft tip for sleeping.

Figure 4:
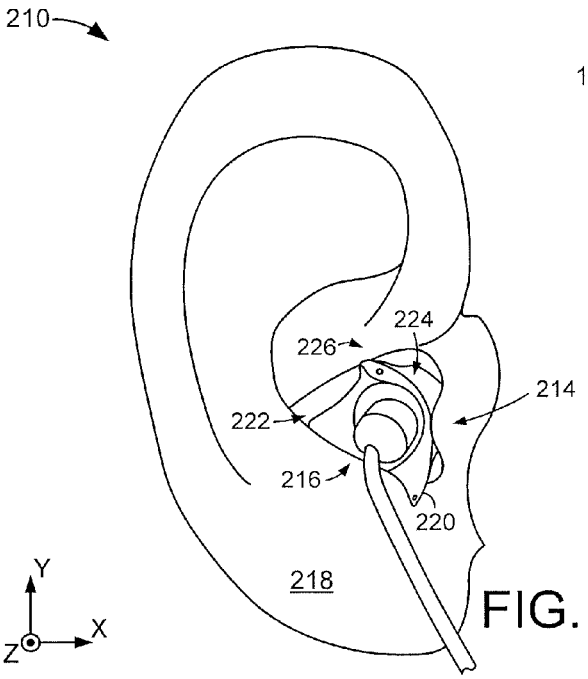
FIG. 4 is a perspective view of an example headphone system constructed and operated in accordance with some embodiments.

It is contemplated that the soft tip 166 and tri-tab 168 features can be configured to provide a more complete seal of the user's ear canal. Such a seal can prevent ambient sounds from reaching the user's ear drum, which can serve as passive noise reduction and ear plugs depending on the user selected combination of soft tip 166 and tri-tab 168 feature. FIG. 4 illustrates a perspective view of a portion of an example headphone system 210 tuned and operated in accordance with some embodiments. As shown, the headphone system 210 can have an in-ear headphone 212 concurrently engaging tragus 214 and antitragus 216 portions of the ear 218 respectively with multiple cantilevered tabs 220.

The in-ear headphone 212 is configured with a housing size, such as less than 8 mm in diameter, which can be positioned in a wide variety of ear 218 shapes and dimensions that cover a large range of user age groups from toddlers to geriatrics. The small housing size of the in-ear headphone 212 accommodates a secure position within the external auditory meatus 222 of the ear 218 and a partial or complete seal of the ear canal 224 by contacting the periphery of the canal 224. The soft tip fitment feature can be tuned for size, shape, and material to contact the ear canal 224 and secure the headphone 212 during times of little user activity.

However, user activities like chewing, talking, and jumping can dislodge the soft tip fitment feature from the external auditory meatus 222. Hence, the tri-tab fitment feature has a tuned size, shape, and material to position the cantilevered tabs 220 in contact with the tragus 214, antitragus 216, and concha 226 concurrently. Such contact between different portions of the external auditory meatus 222 allows the in-ear headphone 212 to comfortably and securely be maintained in the ear 218 of a user during rigorous activity and movement. The cantilevered tabs 220 of the tri-tab fitment feature can be tuned, in some embodiments, to contact multiple different aspects of the external auditory meatus 222 simultaneously, which can further provide anchor points for the in-ear headphone 212 to maintain contact and pressure during user movement.

Figure 5:
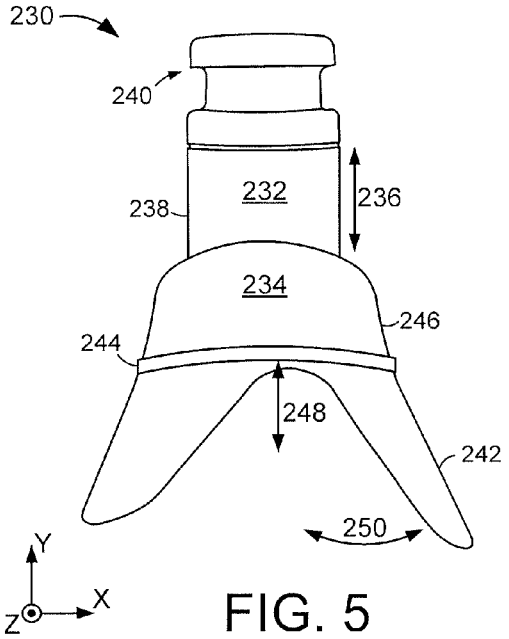
FIG. 5 illustrates a portion of an example in-ear headphone configured in accordance with various embodiments.

The tuned dimensions of the cantilevered tabs 220 may be complemented by the ability of the tri-tab fitment feature to move in relation to the housing. FIG. 5 depicts a perspective view of a portion of an example in-ear headphone 230 that has a tuned configuration in accordance with various embodiments. The partially disassembled state of the in-ear headphone 230 shown in FIG. 5 illustrates how the headphone housing 232 can provide a body on which the tri-tab fitment feature 234 can slide along a predetermined direction 236.

The sliding engagement can be tuned by providing a predetermined friction factor between the fitment feature 234 and housing 232 that allows tri-tab 234 movements in response to pressure above a threshold. For example, the housing 232 may be coated or have a roughness that promotes or inhibits fitment feature 234 movement during expected user movement and activity. In other words, the tri-tab fitment feature 234 can be tuned to slide on the housing 232 in response to pressure that is high enough to be only applied by a user, such as during initial placement of the headphone 230 in a user's ear, or tuned to slide in response to common and expected user movement, such as chewing. It is contemplated that the housing 232 may have tapered sidewalls 238 that allow tri-tab 234 movement, but inhibit sliding beyond a predetermined point on the housing 232 without pressure being applied by the user.

It is further contemplated that a pressure member, such as a spring, can be incorporated into the headphone 230 to continually or sporadically apply bias pressure to the tri-tab fitment feature 234 to push outward, away from the bulbous soft tip attachment portion 240 of the housing 232. Such bias pressure can ensure the cantilevered tabs 242 contact and exert pressure on at least the tragus and antitragus of a user's ear regardless of the intensity and type of user movement.

It should be noted that the tuned construction of the cantilevered tabs 242 with silicon or a flexible polymer can exert continual pressure on at least the tragus and antitragus of a user's ear. However, the flexible nature of the material may be too compliant and not secure the headphone 230 during user movement. Such issues can be accommodated by the incorporation of a tension ring 244 into the tri-tab fitment feature 234. The tension ring 244 can be placed internal or external to the unitary body 246 of the fitment feature 234 and be tuned to move along direction 248 to temporarily or permanently alter the quiescent state of one or more of the cantilevered tabs 242. In other words, the cantilever tabs 242 can have a quiescent state that is dictated by the shape and material of the tri-tab fitment feature 234 and that quiescent state may be changed, such as by rotating a tab 242 inward along direction 250, to provide optimized shapes and comfort for a user wearing the in-ear headphone 230.

Figure 6:
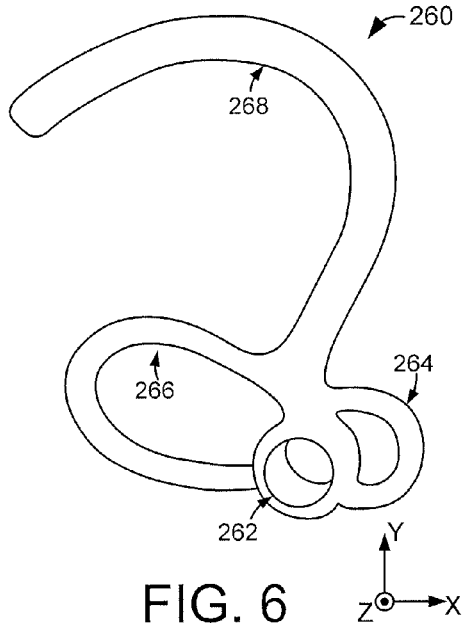
FIG. 6 displays an example securement feature capable of being utilized in the headphone system of FIGS. 2A and 2B in accordance with some embodiments.

Although the soft tip and tri-tab 234 fitment features may provide increased resiliency to becoming dislodged from a user's ear during user movement, a user may desire different securement means. FIG. 6 shows a perspective view of a securement feature 260 that can be attached and detached from an in-ear headphone, such as headphone 140 of FIG. 2A. It is noted that the securement feature 260 can independently or concurrently function with soft tip and tri-tab fitment features installed or not installed and/or in contact with various portions of a user's ear. While not required or limiting, the securement feature 260 can be configured with a housing aperture 262 that can surround the housing of an in-ear headphone.

The housing aperture 262 can be tuned to be capable of sliding, or resist sliding, in relation to the headphone housing. In accordance with some embodiments, the housing aperture 262 can protrude from a tragus 264 and concha 266 portions that are respectively shaped to contact some or all of the tragus and concha regions of a user's ear. The increased girth and strength afforded by the securement feature 260 compared to the soft tip and tri-tab fitment features can provide increased pressure and securement of the in-ear headphone, which can accommodate rigorous user activity with less risk of the in-ear headphone from losing position with respect to the user's ear canal and external auditory meatus.

The securement feature 260 may further have an ear loop 268 that is configured to encircle a portion of the user's ear, such as where the helix meets the skull, and provide increased rigidity to the in-ear headphone position. The ability to selectively attach and remove the securement feature 260 from an in-ear headphone can allow a user to customize the fit, feel, and rigidity of the in-ear headphone. For instance, a user may install the securement feature 260 during exercising, such as running or playing basketball, and subsequently remove the securement feature 260 and allow the soft tip and tri-tab fitment features to secure the in-ear headphone during times of reduced user activity, such as talking, working, and eating.

Figure 7:
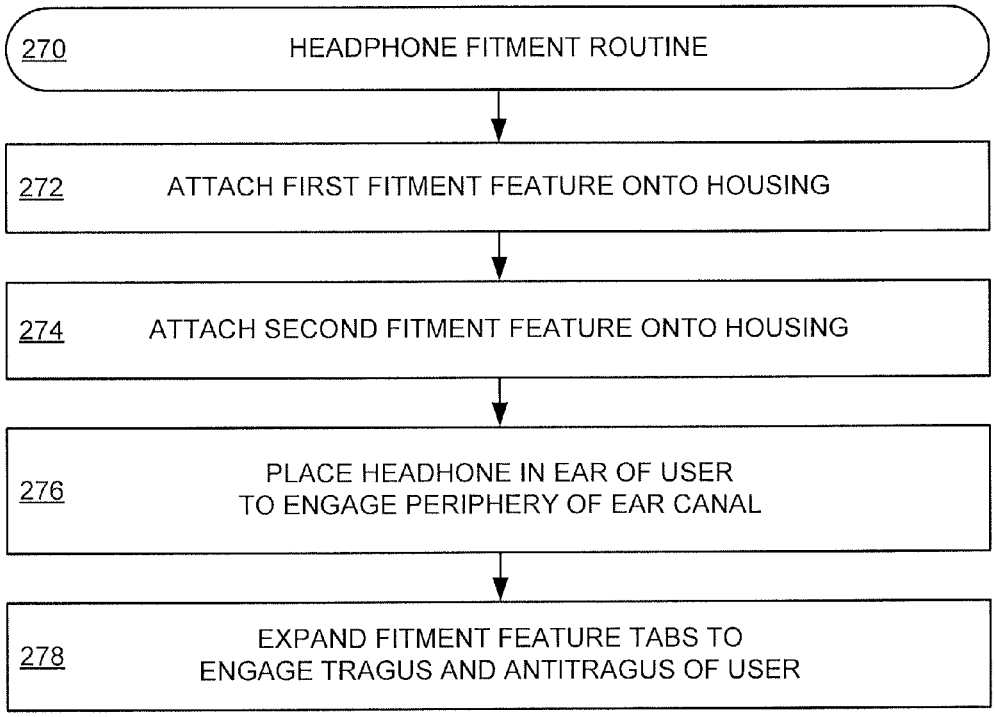
FIG. 7 displays an example headphone fitment routine that may be carried out in accordance with assorted embodiments.

With the unlimited variety of in-ear headphone fitting feature configures afforded by the pliable soft tip fitment feature, flexible tri-tab fitment feature, and rigid securement feature, a user can cater their headphone listening experience at will to a diverse range of comfort and sound reproduction arrangements. FIG. 7 is a headphone fitment routine 270 that generally describes how one or more in-ear headphones can be secured within the external auditory meatus of a user in accordance with assorted embodiments. While not required or limiting, routine 270 may begin by attaching a first fitment feature onto a housing in step 272. The first fitment feature may be the securement feature 270 of FIG. 6 or a tri-tab fitment feature providing a plurality of flexible cantilevered tabs.

Step 274 may then attach a second fitment feature onto the housing, which may involve positioning a soft tip fitment feature having a predetermined size and shape onto a bulbous end of the housing, proximal an audio driver. The placement of the first and second fitment features can allow the in-ear headphone to be positioned within the ear of a user in step 276 to engage at least the periphery of the ear canal and occupy a portion of the external auditory meatus of the user's ear. It is contemplated that the soft tip and/or tri-tab fitment features can be manipulated, such as squeezed and expanded, prior to insertion into the user's ear. In yet, various embodiments expressly expand at least one cantilever tab of the tri-tab fitment feature in step 278 so that the feature concurrently engages the tragus and antitragus of the user's ear.

It can be appreciated that step 278 may involve sliding the tri-tab fitment feature along the headphone housing, positioning an electrical wire, and sealing a portion of the ear canal to secure the in-ear headphone in place with comfort. The ability for a user to selectively manipulate the fitment features, and specifically the cantilevered tabs of the tri-tab fitment feature, can allow the in-ear headphone to conform to nearly any size and shape of ear and external auditory meatus as well as provide continued, secure comfort regardless of the type and intensity of user activity.

What is claimed is:

1. An apparatus comprising:

a housing sized to fit in an external auditory meatus of a user, the housing having an exterior periphery extending completely around the housing, the housing comprising at least one audio driver; and a fitment feature contacting the housing and having a plurality of flexible flanges cantilevered from a unitary base, the unitary base continuously extending to surround and contact the exterior periphery of the housing to present the plurality of flexible flanges, the fitment feature configured to engage a tragus of the user to secure the housing within the external auditory meatus.

2. The apparatus of claim 1, wherein the fitment feature is slidingly adjustable between opposite ends of the housing.

3. The apparatus of claim 1, wherein each flexible flange of the plurality of flexible flanges has a continuously curvilinear boundary surface.

4. The apparatus of claim 1, wherein the unitary base of the fitment feature continuously contacts a curvilinear exterior surface that defines the exterior periphery and surrounds the housing.

5. The apparatus of claim 1, wherein the at least one audio driver is connected to an audio source via a wire extending through the fitment feature.

6. The apparatus of claim 1, wherein each flexible flange of the plurality of flexible flanges is independently articulable.

7. The apparatus of claim 1, wherein the fitment feature slides between a notch in the housing and a wire extending from the housing.

8. The apparatus of claim 1, wherein each flexible flange of the plurality of flexible flanges is biased away from the housing.

9. The apparatus of claim 8, wherein a tension ring slidingly engages the unitary base and plurality of flexible flanges to alter the bias of each flexible flange of the plurality of flexible flanges.

10. The apparatus of claim 1, wherein the housing comprises a single hollow member.

11. The apparatus of claim 1, wherein a flexible tip is secured to a bulbous end of the housing.

12. An apparatus comprising first and second housings each sized to fit in an external auditory meatus of first and second ears of a user, each housing having an exterior periphery extending completely around the housing and comprising at least one audio driver, the first housing having a fitment feature contacting the first housing, the fitment feature comprising three flexible flanges cantilevered from a single unitary base, the single unitary base continuously extending to surround and contact the exterior periphery of the first housing to present the three flexible flanges at different radial orientations relative to the first housing, the fitment feature configured to concurrently engage a tragus and antitragus of the user to secure the first housing within the external auditory meatus.

13. The apparatus of claim 12, wherein the second housing has a securement feature extending from the second housing to a rear surface of the second ear of the user.

14. The apparatus of claim 13, wherein the securement feature concurrently engages concha and tragus portions of the second ear of the user.

15. The apparatus of claim 13, wherein the securement feature contacts a helix portion of the second ear of the user.

16. The apparatus of claim 13, wherein the securement feature is slidingly engaged with the second housing.

17. A method comprising:

fitting a first housing in a first external auditory meatus of a user, the first housing having an exterior periphery extending completely around the housing and comprising at least one audio driver;

engaging a tragus of the user with a fitment feature to secure the first housing within the first external auditory meatus, the fitment feature contacting the housing and having a plurality of flexible flanges cantilevered from a unitary base, the unitary base continuously extending to surround and contact the exterior periphery of the first housing to present the plurality of flexible flanges; and sliding the fitment feature along the exterior periphery of the first housing to change a relative position of the plurality of flexible flanges with respect to a sound tunnel of the first housing.

18. The method of claim 17, wherein at least one of the plurality of flexible flanges are expanded to engage the tragus and antitragus of the user.

19. The method of claim 17, wherein a first flexible tip is positioned on the first housing and second flexible tip is positioned on a second housing, the first and second flexible tips being different sizes.

20. The method of claim 17, wherein the unitary base of the fitment feature is configured to be selectively positioned anywhere on the first housing between the sound tunnel and a distal end of the first housing.

* * * * *